US007518049B2

(12) United States Patent
Beal

(10) Patent No.: US 7,518,049 B2
(45) Date of Patent: Apr. 14, 2009

(54) UNDERWATER CHIME AND METHOD OF USE THEREOF

(76) Inventor: Dale Beal, 58 Motor Ave., Farmingdale, NY (US) 11735

( * ) Notice: Subject to any disclaimer, the term of this patent is extended or adjusted under 35 U.S.C. 154(b) by 635 days.

(21) Appl. No.: 10/983,815

(22) Filed: Nov. 8, 2004

(65) Prior Publication Data

US 2005/0098082 A1 May 12, 2005

Related U.S. Application Data

(60) Provisional application No. 60/518,439, filed on Nov. 7, 2003.

(51) Int. Cl.
*G10D 3/00* (2006.01)

(52) U.S. Cl. ..... 84/402

(58) Field of Classification Search ..... 84/402–404, 84/406, 410
See application file for complete search history.

(56) References Cited

U.S. PATENT DOCUMENTS

| | | | | |
|---|---|---|---|---|
| 6,417,763 | B1 * | 7/2002 | Petruzzi | 340/392.1 |
| 7,009,098 | B2 * | 3/2006 | Carter | 84/410 |
| 2004/0011184 | A1 * | 1/2004 | Prall | 84/402 |

* cited by examiner

*Primary Examiner*—Kimberly R Lockett
(74) *Attorney, Agent, or Firm*—Myers & Kaplan, LLC; Ashish D. Patel

(57) ABSTRACT

An underwater chime and method of use thereof, wherein the underwater chime functions to enhance the pacifying effect of any swimming pool, whirlpool, jet tub and/or spa environment by effectively transmitting soothing, relaxing and meditative chimes/sound waves throughout the aquatic medium.

15 Claims, 2 Drawing Sheets

UNDERWATER CHIME AND METHOD OF USE THEREOF

CROSS-REFERENCE AND PRIORITY CLAIM TO RELATED APPLICATIONS

To the fullest extent permitted by law, the present nonprovisional patent application claims priority to and the full benefit of provisional patent application entitled "UNDERWATER CHIME AND METHOD THEREFOR", filed on Nov. 7, 2003, having assigned Ser. No. 60/518,439 wherein said application is incorporated herein by reference.

TECHNICAL FIELD

The present invention relates generally to chimes, and more specifically to an underwater chime and method of use thereof. The present invention is particularly suitable for, although not strictly limited to, creating and conveying relaxing and harmonious chimes throughout a swimming pool, spa, whirlpool and/or the like.

BACKGROUND OF THE INVENTION

Many residential homes and/or public fitness facilities possess swimming pools, jet tubs, whirlpools, spas and/or other aquatic facilities that are typically utilized for a variety of recreational purposes, wherein one such purpose is for relaxation. Specifically, many individuals utilize swimming pools, jet tubs, whirlpools, spas and/or the like for the physically soothing sensation of water against their body and to recuperate after any physically and/or mentally strenuous activity and/or to relieve general bodily fatigue.

Although such pools/spas are therapeutic in themselves, many individuals often incorporate music and/or other soothing sounds offered via a conventional electronic audio system in attempts to further enhance their relaxing pool/spa experience. However, such conventional audio equipment is limited to aboveground or above-pool transmission of sound, and, as such, is generally incapable of effectively transmitting sound waves underwater, as submersion of the electronic audio equipment is not only hazardous, but would likely result in irreparable damage thereto.

Therefore, it is readily apparent that there is a need for an underwater chime and method of use thereof, wherein utilization of such an underwater chime functions to enhance the pacifying effect of any pool and/or spa environment by effectively transmitting soothing, relaxing and meditative chimes/sound waves throughout the aquatic medium.

BRIEF SUMMARY OF THE INVENTION

Briefly described, in a preferred embodiment, the present invention overcomes the above-mentioned disadvantages and meets the recognized need for such a device by providing an underwater chime and method of use thereof, wherein addition of the underwater chime to any pool and/or spa environment significantly enhances the inherent pacifying effect thereof by effectively transmitting and conveying soothing, relaxing and meditative chimes/sound waves therethrough.

According to its major aspects and broadly stated, the present invention in its preferred form is an underwater chime having a chime housing member, a chime mechanism, a fin, a suspension mechanism and a mounting bracket.

More specifically, the present invention is an underwater chime having a chime housing member, a chime mechanism housed within the chime housing member, a fin surrounding the chime housing member and protruding substantially perpendicular therefrom, a suspension mechanism preferably in the form of a chain, wherein one end of the chain is engaged to the fin, and wherein the opposing end of the chain is engaged to a mounting bracket attached proximal to the pool/spa water inlet and/or outlet.

Accordingly, a feature and advantage of the present invention is its ability to significantly enhance a pool/spa user's underwater experience via the transmission of soothing, relaxing and meditative chimes/sound waves therethrough.

Another feature and advantage of the present invention is its ability to generate a continuous, random variety of chime sound during utilization thereof in a pool/spa type setting.

Still another feature and advantage of the present invention is its ability to function without the need of batteries, motors and/or other types of power sources.

Yet another feature and advantage of the present invention is its ability to effectively and substantially uniformly transmit soothing chime sounds throughout most any swimming pools, jet tubs, whirlpools, spas and/or the like.

Still yet another feature and advantage of the present invention is the ability to be expeditiously attached and detached from most any swimming pools, jet tubs, whirlpools, spas and/or the like with substantially ease.

A further feature and advantage of the present invention is its simplicity of design.

Still a further feature and advantage of the present invention is its durability.

Yet a further feature and advantage of the present invention is its ability to function maintenance-free.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

In describing the preferred and alternate embodiments of the present invention, as illustrated in FIGS. 1-4, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
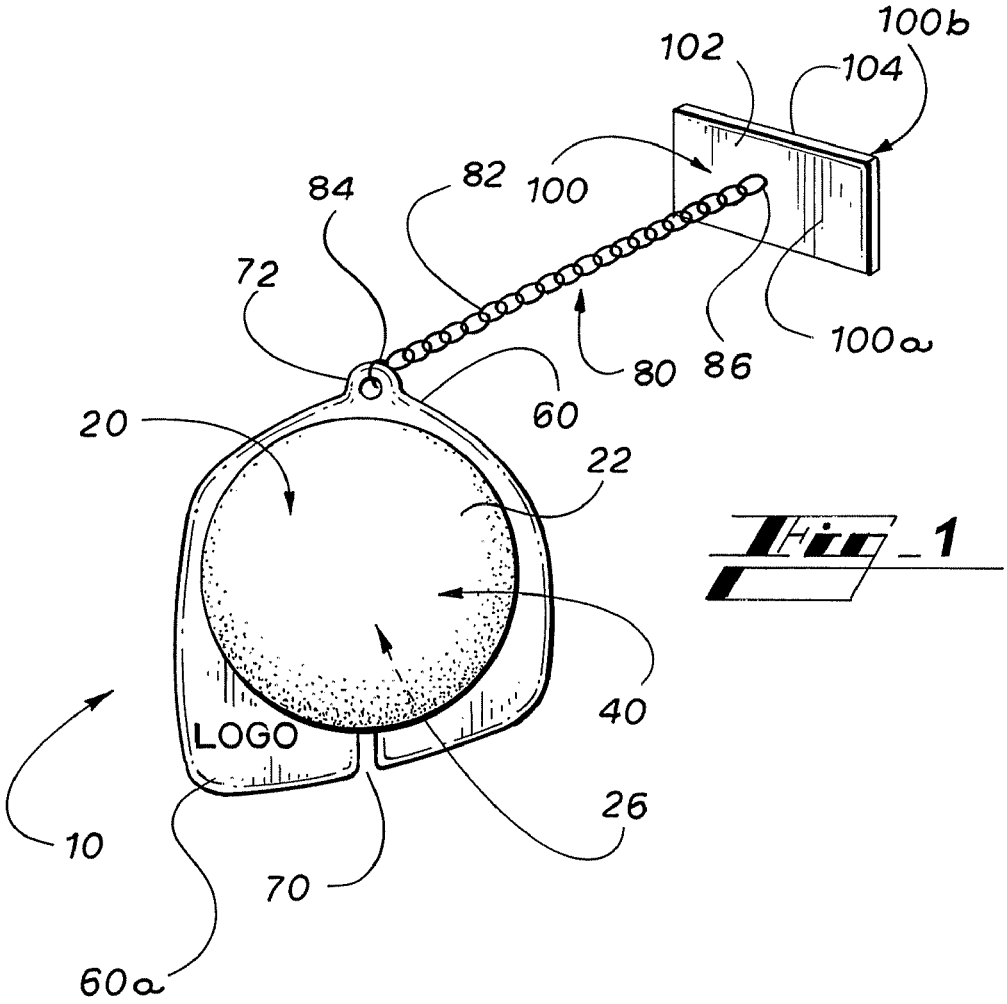
FIG. 1 is a front perspective view of an underwater chime according to a preferred embodiment of the present invention.
Figure 2:
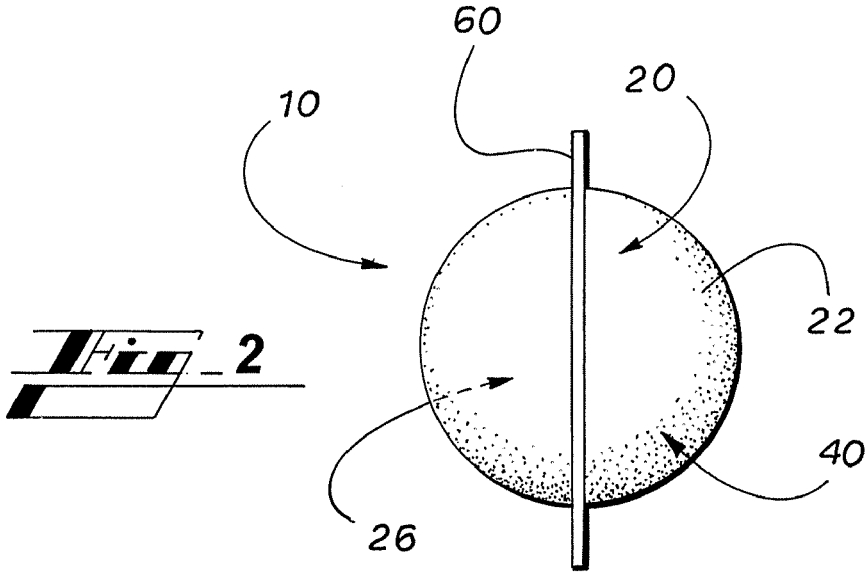
FIG. 2 is a side perspective view of an underwater chime according to a preferred embodiment of the present invention.
Figure 3:
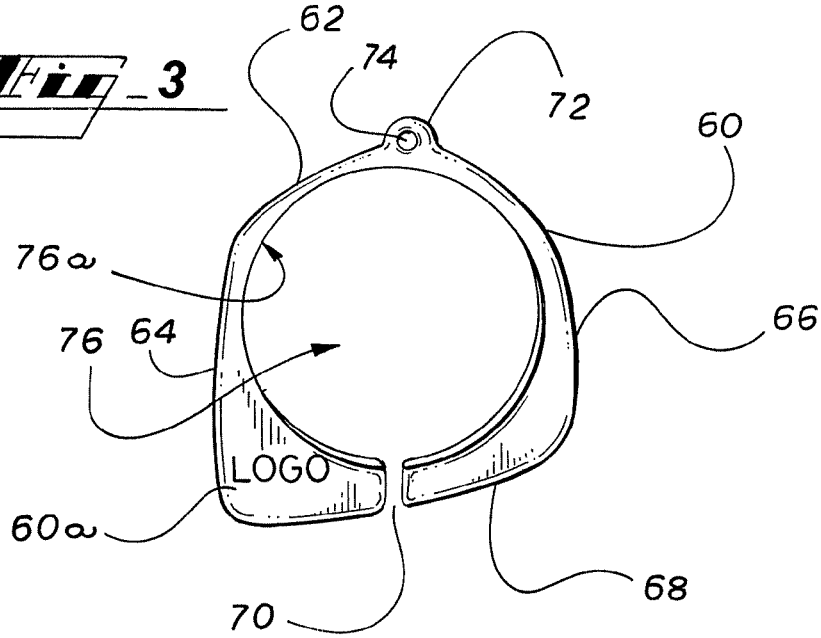
FIG. 3 is a front perspective view of the fin of an underwater chime according to a preferred embodiment of the present invention.

Referring now to FIGS. 1-3, the present invention in its preferred embodiment is a device 10, wherein device 10 is an underwater chime generally preferably having chime housing member 20, chime mechanism 40, fin 60, suspension mechanism 80 and mounting bracket 100.

Chime housing member 20 is preferably a ball or sphere 22, wherein sphere 22 is preferably hollow and preferably formed from a suitable metal or metal alloy such as, for exemplary purposes only, stainless steel, aluminum, brass, bronze, iron, plated or coated metals, or the like, that are preferably resistant to rust, corrosion and/or other typical water damage. Alternatively, sphere 22 may be manufactured from a ceramic material. Although the preferred material of sphere 22 is metal, it is contemplated in an alternate embodiment that other suitable materials could be utilized, such as, for exemplary purposes only, glass and/or glass. It is contemplated in yet another alternate embodiment that chime housing member 20 could be any shape, such as, for exemplary purposes only, oval, square, diamond, pyramidal, cube, rectangular and/or any other desired shape and/or three-dimensional shape.

Preferably housed within hollow interior 26 is chime mechanism 40, wherein chime mechanism 40 is preferably any suitable chime mechanism as known within the art, such as, for exemplary purposes only, stress-ball chimes and/or bells.

Formed preferably equatorially on sphere 22 is fin 60, wherein fin 60 is preferably substantially flat and preferably formed from plastic and/or any other suitable material known within the art, such as, for exemplary purposes only, rubber, metal and/or glass. Fin 60 preferably possesses rounded side 62, first straight side 64, second straight side 66 and angled side 68, wherein angled side 68 is preferably formed opposite rounded side 62, and wherein angled side 68 preferably possesses slit 70 centrally formed therethrough to facilitate placement of fin 60 onto sphere 22 of chime housing member 20, as more fully described below. Rounded side 62 of fin 60 preferably possesses protuberance 72 formed thereon, wherein protuberance 72 is preferably of the same thickness as fin 60, and wherein protuberance 72 preferably possesses throughhole 74 centrally formed therethrough for the securement of suspension mechanism 80 thereto, as more fully described below.

Fin 60 further preferably possesses centrally formed aperture 76, wherein aperture 76 is dimensioned to receive sphere 22 therein, and wherein edge 76A of aperture 76 is preferably secured to sphere 22 via any suitable securing means known within the art, such as, for exemplary purposes only, epoxies, resins, solder, or integral formation therewith, thus securing fin 60, in general, to sphere 22. It is contemplated in an alternate embodiment that edge 76A of aperture 76 could be dimensioned to be received and seated within a groove formed around the circumference of sphere 22, thereby securing fin 60 therein.

Fin 60 preferably functions as a fluid flow interrupter, permitting device 10 to bounce and/or twirl about when struck by water expelled through a water outlet and/or taken in via a water inlet of a pool/spa, thus causing chime mechanism 40 to jostle about within sphere 22 and produce a variety of random soothing chime sounds, as more fully described below. Furthermore, area 60A of fin 60 may receive any selected indicia 60B thereon, such as, for exemplary purposes only, company logos, designs, holograms, advertisements, textual material, and combinations thereof.

Preferably in secured communication with throughhole 74 of protuberance 72 of fin 60 is end 84 of suspension mechanism 80, wherein suspension 80 is preferably a ball-type chain 82, and wherein opposing end 86 of chain 82 is preferably in secured communication with front surface 100A of mounting bracket 100. Although suspension mechanism 80 is preferably a chain 82, it is contemplated in an alternate embodiment that suspension mechanism 80 could be a string, plastic wire, twine and/or any other suitable suspension mechanism as known within the art. Chain 82 is preferably adjustably positioned through throughhole 74 of protuberance 72 of fin 60 to enable proper positioning of device 10 in front of a water inlet and/or outlet, as more fully described below.

Mounting bracket 100 is preferably a substantially flat member 102, possessing a securing means 104 for securing mounting bracket 100 to the cap plate of a pool/spa in front of a water inlet and/or outlet, wherein securing means 104 is positioned on rear surface 100B of mounting bracket 100, and wherein securing means 104 is preferably a waterproof removable adhesive and/or any other suitable securing means as known within the art, such as, for exemplary purposes only, hook-and-loop fasteners, screws, snap-fit mechanisms and/or the like. Mounting bracket 100 is preferably formed from plastic and/or any other suitable material as known within the art, such as, for exemplary purposes only, metal and/or rubber.

Figure 4:
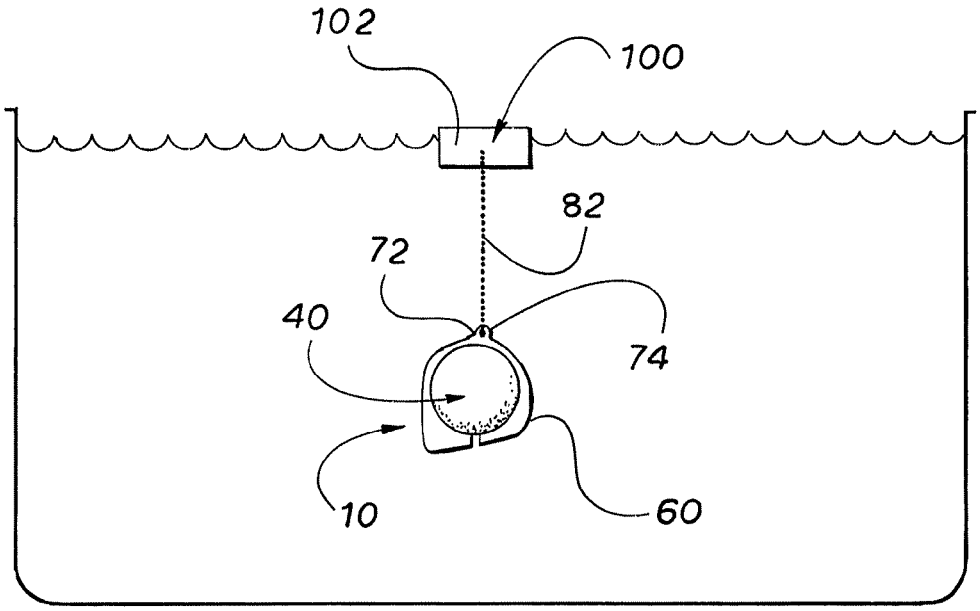
FIG. 4 is a perspective view of an underwater chime according to a preferred embodiment of the present invention, showing the device in use.

Referring now to FIG. 4, in use and during non-operation of the pump of pool/spa being treated with device 10, mounting bracket 100 is preferably secured to the cap plate of a pool/spa in front of a water inlet and/or outlet. Chain 82 is then preferably adjusted via pulling chain 82 through throughhole 74 of protuberance 72 of fin 60 to enable proper positioning of device 10 in front of a water inlet and/or outlet. The pool/spa pump is then preferably reactivated to permit water, either ejected from a water outlet or drawn in by a water inlet, to strike fin 60, thereby causing device 10 to bounce/twirl about and thus, chime mechanism 40 to jostle about within sphere 22 to produce a variety of random soothing, relaxing and/or meditative chime sounds that are effectively transmitted/conveyed throughout the aquatic medium.

It is contemplated in an alternate embodiment that device 10 could possess any number of fins 60 to increase the turbulence of device 10 within a pool/spa and thus, overall audibility/pitch of chime sounds produced therefrom.

It is contemplated in another alternate embodiment that device 10 could possess other forms of auditory creating mechanisms to produce sounds other than chimes.

It is contemplated in yet another alternate embodiment that device 10 could be employed in any aquatic setting.

It is contemplated in still another alternate embodiment that device 10 could be secured to a pool/spa user to create chime sounds in response to movement of the user through the pool/spa.

It is contemplated in still yet another alternate embodiment that device 10 could dispense with mounting bracket 100, and be permitted to freely float, alone or within or connected to a suitable floatation device, on the aquatic surface to create chime sounds in response to natural movement the pool/spa waves or ripples.

It is contemplated in a further alternate embodiment that device 10 could be secured to a shallow water and/or deep water diver to create chime sounds in response to movement of the diver through the aquatic body.

It is contemplated in still a further alternate embodiment that device 10 could possess a light mechanism that would activate in response to the chime sounds created by device 10, thus creating a soothing display of light reflections throughout a pool/spa in accord with the chime sounds.

It is contemplated in yet a further alternate embodiment that fin 60 could be pocket-like/cup-like to assist in the capture of water therein and thus cause the rotation/twirling of device 10 within a pool/spa It is contemplated in still yet a further alternate embodiment that device 10 could be utilized outside an aquatic setting.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A chime for use in an aquatic body, said chime comprising:

a chime housing;

a chime creating mechanism;

a fluid flow interrupter, wherein said fluid flow interrupter comprises an indicia disposed thereon, said indicia selected from the group consisting of logos, designs, holograms, advertisements, textual material, and combinations thereof; and, means for suspending said chime housing below the aquatic body.

2. The chime of claim 1, wherein said chime housing comprises said chime creating mechanism disposed therewithin.

3. The chime of claim 2, wherein said fluid flow interrupter is disposed on said chime housing.

4. The chime of claim 2, wherein said fluid flow interrupter is a fin disposed on said chime housing.

5. The chime of claim of 4, wherein said fin interrupts fluid flowing past or over said chime when said chime is disposed below the aquatic body, thereby causing said chime housing to jostle or twirl, and thus said chime creating mechanism to emit a chime sound.

6. The chime of claim 2, wherein said suspending means is a chain connected to a mounting bracket, said chain further connected to said fluid flow interrupter, wherein said mounting bracket may be utilized to mount said chime to a selected surface.

7. The chime of claim 6, wherein said mounting bracket may be utilized to mount said chime to a swimming pool wall such that said chime housing is disposed proximate to a water inlet or outlet of the swimming pool, whereby water flowing in or out of the water inlet or outlet, respectively, strikes said fluid flow interrupter and causes said chime housing to jostle or twirl, and thus said chime creating mechanism to emit a chime sound.

8. A method of creating sound waves underwater, comprising the steps of:

a. obtaining a chime for underwater use, said chime comprising:

a means for chiming; and, a fluid flow interrupter; and, b. positioning said chime in front of a water exchange port of a swimming pool; and, c. allowing the swimming pool to operate so as to permit the water exchange port to effectuate a forced water current against or over said chime to enable said chiming means to emit chime sounds underwater.

9. The method of claim 8, further comprising the step of: allowing the forced water current to strike said fluid flow interrupter and cause said means for chiming to emit chime sounds underwater.

10. A chime for use in an aquatic body, said chime comprising:

a chime housing;

a chime creating mechanism;

a fluid flow interrupter; and, means for suspending said chime housing below the aquatic body, wherein said suspending means is connected to a mounting bracket and to said fluid flow interrupter, wherein said mounting bracket may be utilized to mount said chime to a swimming pool wall such that said chime housing is disposed proximate to a water inlet or outlet of the swimming pool and suspended thereabout via said suspending means, and whereby water flowing in or out of the water inlet or outlet, respectively, strikes said fluid flow interrupter and causes said chime housing to jostle or twirl, and thus said chime creating mechanism to emit a chime sound.

11. The chime of claim 10, wherein said chime housing comprises said chime creating mechanism disposed therewithin.

12. The chime of claim 10, wherein said fluid flow interrupter is disposed on said chime housing.

13. The chime of claim 10, wherein said fluid flow interrupter is a fin disposed on said chime housing.

14. The chime of claim of 13, wherein said fin interrupts fluid flowing past or over said chime when said chime is disposed below the aquatic body, thereby causing said chime housing to jostle or twirl, and thus said chime creating mechanism to emit a chime sound.

15. The chime of claim 10, wherein said fluid flow interrupter comprises an indicia disposed thereon, wherein said indicia is selected from the group consisting of logos, designs, holograms, advertisements, textual material, and combinations thereof.

* * * * *